US007032975B2

(12) United States Patent
Hummler et al.

(10) Patent No.: US 7,032,975 B2
(45) Date of Patent: Apr. 25, 2006

(54) MEDICAL OR DENTAL TREATMENT CHAIR

(75) Inventors: Georg Hummler, Biberach-Ringschnait (DE); Reinhold Von Bank, Schemmerhofen (DE); Karlheinz Rapp, Mittelbiberach (DE)

(73) Assignee: Kaltenbach & Voigt GmbH & Co., Biberach (DE)

( * ) Notice: Subject to any disclaimer, the term of this patent is extended or adjusted under 35 U.S.C. 154(b) by 29 days.

(21) Appl. No.: 10/239,258

(22) PCT Filed: Mar. 22, 2001

(86) PCT No.: PCT/EP01/03270

§ 371 (c)(1),
(2), (4) Date: Sep. 20, 2002

(87) PCT Pub. No.: WO01/70169

PCT Pub. Date: Sep. 27, 2001

(65) Prior Publication Data

US 2003/0030314 A1 Feb. 13, 2003

(30) Foreign Application Priority Data

Mar. 22, 2000 (DE) ..... 100 14 063

(51) Int. Cl.
*A47C 7/36* (2006.01)

(52) U.S. Cl. ..... 297/409; 297/410

(58) Field of Classification Search ..... 297/408, 297/409, 410

See application file for complete search history.

(56) References Cited

U.S. PATENT DOCUMENTS

| | | | | |
|---|---|---|---|---|
| 240,476 A | * | 4/1881 | Starr | 297/358 |
| 426,069 A | * | 4/1890 | Rogers | 297/402 |
| 2,630,887 A | | 3/1953 | Paquin | |
| 3,454,303 A | * | 7/1969 | Dangauthier | 297/396 |
| 3,885,831 A | * | 5/1975 | Rasmussen | 297/410 |

(Continued)

FOREIGN PATENT DOCUMENTS

| | | | |
|---|---|---|---|
| DE | 2 232 726 | | 1/1974 |
| DE | 29 32 345 | A1 | 2/1981 |
| DE | 82 07 541.7 | | 7/1983 |
| DE | 3347255 | A1 * | 7/1985 |
| DE | 36 11 282 | A1 | 10/1987 |
| DE | 296 20 800 | U1 | 3/1998 |
| DE | 296 20 801 | U1 | 4/1998 |
| DE | 29620801 | U1 * | 5/1998 |
| EP | 0 673 633 | A2 | 9/1995 |
| EP | 0 701 806 | A1 | 3/1996 |
| FR | 2 122 163 | | 8/1972 |
| FR | 2 367 482 | | 5/1978 |
| JP | 06098913 | A * | 4/1994 |

OTHER PUBLICATIONS

English Translation of the International Preliminary Examination Report.

*Primary Examiner*—Peter M. Cuomo
*Assistant Examiner*—Joseph Edell
(74) *Attorney, Agent, or Firm*—Marshall, Gerstein & Borun LLP

(57) ABSTRACT

The invention relates to a medical or dental treatment chair (1) having a seat part (2), a back part (4), a carrier part (16) arranged on the back part (4), an intermediate lever (23) which with its one end is pivotably connected with the carrier part (16), a head support lever (24) which with its one end is pivotably connected to the other end of the intermediate lever (23) and carries a head support pad (21), and an intermediate lever adjustment motor (M3) which is effective between the carrier parts (16) and the intermediate lever (23). For the support function there is provided a head support lever adjustment motor (M4) which is effective between the intermediate lever (23) and the head support lever (27).

5 Claims, 5 Drawing Sheets

U.S. PATENT DOCUMENTS 4,128,797 A * 12/1978 Murata ..... 318/666
4,840,429 A * 6/1989 Stockl ..... 297/409
4,848,838 A * 7/1989 McCrackin et al. ..... 297/391
5,315,726 A 5/1994 Borenstein
5,700,054 A * 12/1997 Lang ..... 297/238
5,730,497 A 3/1998 Raymond et al.
5,927,804 A 7/1999 Cuevas
6,520,585 B1 * 2/2003 Georg et al. ..... 297/408

* cited by examiner

MEDICAL OR DENTAL TREATMENT CHAIR

RELATED APPLICATION DATA

The present patent is a National Stage of international application PCT/EP01/03270, filed on Mar. 22, 2001.

FIELD OF THE INVENTION

The invention relates to a medical or dental treatment chair having a head support which is adjustable in consideration of different treatments of the patient.

BACKGROUND OF THE INVENTION

It is known to provide for such an adjustment at least one motorized drive which is associated with the head support. In the case of a motorized drive, the head support is positioned in the adjusted disposition, against an unintended movement, due to the self-locking of the motorized drive. For the purpose of reducing the mechanical outlay there have, however, also been developed manually operable adjustment devices for the head support. With this it is necessary to fix the head support in the respective adjusted position, against an unintended displacement, by means of a fixing device. With regard to the state of the art attention is directed to DE 82 07 541 U1, DE 296 20 801 U1, EP 0 701 806 A1 and EP 0 673 633 A2.

A treatment chair of the kind indicated in the preamble of claim 1 is described in DE 29 32 345 A1. With this known treatment chair, a head support is connected in a middle position by means of a base joint with the free end of a telescopic support part which at its other end is pivotably connected by means of a joint with a backrest of the treatment chair. For pivoting the telescopic support part in its base joint there is provided a piston-cylinder unit which is jointed on to the backrest at a radial spacing from the base joint and engages in a jointed manner with its other end at the forward end of the telescopic support part. There is associated with the telescopic support part a latching device which makes it possible selectively to latch the telescopic support parts to one another or to release them. The base joint can be selectively locked or released with a second latching device. With this known treatment chair it is possible, depending upon the actuation of the first or second latching device, to extend or retract the head support by means of an appropriate actuation of the piston-cylinder unit or to pivot the head support around the joint axis of the base joint, the head support itself being freely pivotably in the joint connecting it with the telescopic support part. This known configuration is complex both with regard to construction and also operation. Further, the support function is unsatisfactory.

SUMMARY OF THE INVENTION

The present invention is based on the object of improving the support function of a treatment chair. Further, a simple construction and operability are to attained.

With the configuration in accordance with the invention both the intermediate lever and also the head support lever are each purposely adjustable by means of the associated adjustment motor, the head support lever, whilst providing a large adjustment range, taking up a stable position. Due to the positioning of the head support lever in the overall large adjustment range, the reliability of support for the patient is improved. The adjustment of the head support may be effected by means of switching on of the adjustment motors successively or simultaneously. In the latter case, the adjustment time can also be considerably reduced.

For the configuration in accordance with the invention, adjustment motors of elongate or rod-like construction are particularly suitable since they can be mounted or integrated on the associated lever, with a small and spatially economic construction. By these means, the adjustment range of the head support lever can be better exploited and thus increased. Linearly acting adjustment motors are suitable which with their one end engage or are supported jointedly, at a working distance from the pivot axis of the associated pivot joint, pivotally on the one joint part and on the other joint part. The operating effort for adjusting the head support pad is slight since the operating person solely needs to actuate a respectively associated control element or a common control element in order to switch on or switch off the desired adjustment motor or motors. It is also possible to so configure an associated control device that certain support dispositions of the head support pad are self-actingly assumed after switching on of the adjustment motor or motors in accordance with a program. By these means the operating effort is further reduced. It is particularly advantageous if the control device is so configured that the operating person can so control the control device that an individual adjustment of the head support pad is possible by means of an appropriate control through the operating person or there is possible an adjustment of the head support pad in accordance with the program.

The invention further has the object of improving a treatment chair with regard to its suitability for children.

The head support can be adjusted to a position in which it forms a largely transition-free continuation of the shell base of the back part. This position distinguishes itself as a particularly advantageous child position, since it is well suited for children not only with regard to its slight spacing from the seat part but also because of its aligned disposition with regard to the backrest, and ensures an advantageous and secure support of the head of the child. Thereby, the support surface of the head support may likewise be formed to be trough-shaped whereby it need not extend in this form over its entire length. The trough-shaped form of the support surface need extend only over a part length of the head support towards the back part. In the end region of the head support away from the back part the trough may be bounded by a transversely running, in particular rounded, swelling into which the trough changes preferably in an inclined or rounded manner.

BRIEF DESCRIPTION OF THE DRAWINGS

Below, the invention and further advantages which can be achieved thereby will be described in more detail with reference to preferred configurations. There is shown.

DETAILED DESCRIPTION OF THE DISCLOSED EMBODIMENTS

Figure 1:
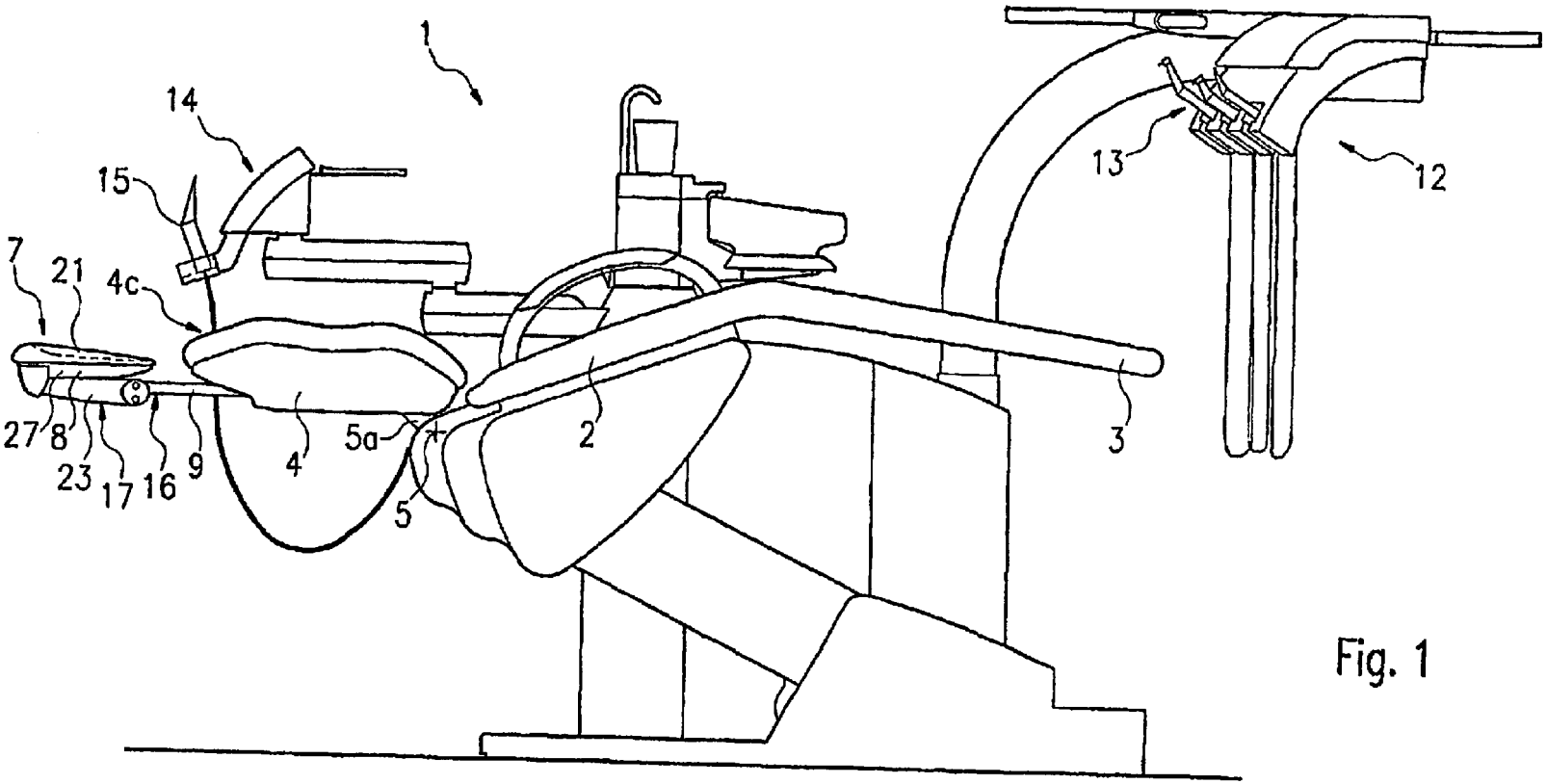
FIG. 1 a treatment chair in accordance with the invention, in a side view.
Figure 2:
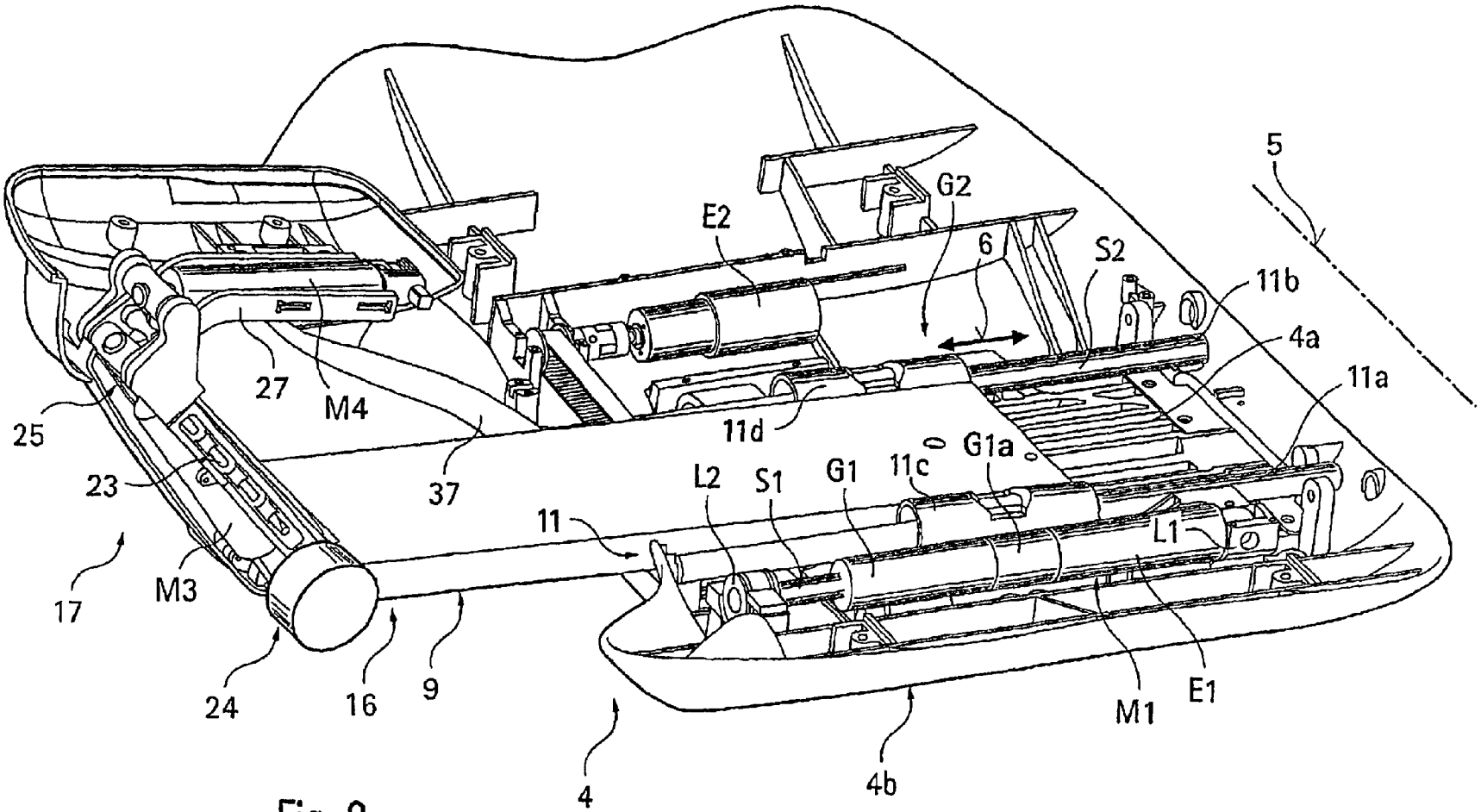
FIG. 2 a back part or a backrest and a head support of a treatment chair, in a perspective view from above.

The main part of the medical or dental treatment chair, designated in its entirety by 1, are a seat part 2, preferably adjustable in position in the vertical longitudinal middle plane E of the chair, having a leg support 3, a backrest 4, which is connected at the rearward end of the seat part 2 by means of a backrest joint 5 having a horizontal joint axis extending transversely of the treatment chair 1, and which is adjustable around the joint axis between an upright sitting position and an approximately horizontal lying position by means of a first adjustment device not shown in detail, and is fixable in the respective adjusted position by means of a first fixing device, and a head support 7 having a base body 8, which is adjustably mounted on the backrest 4 by means of one or two carrier rods 9 running in the longitudinal direction of the backrest 4 and forming a carrier part. A first adjustable carrier for treatment instruments 13 is designated by 12, which treatment instruments will primarily be used by the dentist, and a second adjustable carrier part for treatment instruments 15 is designated by 14, which treatment instruments will primarily be used by an assistant.

The carrier rods 9, extending in the longitudinal direction of the backrest 3, which are adjustably connected with the backrest 3, form a head support carrier part 16. The head support 7 is adjustable on this carrier part by means of a pivot device 17, in the vertical longitudinal middle plane E of the treatment chair 1, and is held fixably in the respective pivot position by means of a second fixing device designated in its entirety by 19, in order to adjust the head support 7 with a pad 21 arranged on its forward or upper side in a desired support position with regard to the head of a patient. A so-formed second adjustment device is designated in its entirety by 22.

The backrest 4 consists of a back base part 4*a* which is connected with the backrest joint 5 by means of joint parts 5*a* illustrated only in FIG. 1, and a backrest part 4*b* which is occupied by a preferably shell-shaped backrest pad 4*c*. Between the back base part 4*a* and the backrest part 4*b* there is formed a schematically illustrated guide 6 in which the backrest part 4*b* is displaceable back and forth on the back base part 4*a* in the longitudinal direction of the backrest 4. For the adjustment there is provided a first adjustment motor M1, preferably in a rod-like construction which with its one end, here the end towards the backrest joint 5, is supported on the back base part 4*a* and with its other end, here the end away from the backrest joint 5, engages on the backrest part 4*b*. For connecting the adjustment motor M1 with the back base part 4*a* and the backrest part 4*d* there are provided on these parts fixed mounting parts L1, L2. The adjustment motor M1 preferably has an electric motor E1 with which there is associated a transmission G1 which transforms its rotating movements into a longitudinal movement. Here, there is preferably involved a spindle drive, the spindle of which is designated by S1. Between the electric motor E and the transmission G1 there may be provided a reduction gear unit G1*a*.

The carrier part 16 is mounted to be displaceable back and forth by means of a second adjustment motor M2 in a second longitudinal guide 11 arranged in the backrest part 4*b*, in the longitudinal direction of the backrest 4. The carrier part 16 is preferably formed by means of a flat slider arranged transversely to the vertical longitudinal middle plane of the treatment chair 1, in order to ensure a flat construction of the backrest 4. The first adjustment motor M1 is located on the one side neighbouring the carrier part 16, while the second adjustment motor M2 is arranged on the other side neighbouring the carrier part 16. The second adjustment motor M2 is also of rod-shaped or elongate structure, and it has preferably an electric motor E2 which is connected with the carrier part 16 by means of a transmission G2 which transforms its rotary movement into a straight line movement. The conversion transmission G2 is in the exemplary embodiment likewise formed by means of a spindle drive, the spindle of which is designated by S2.

The longitudinal guide 11 for the carrier part 16 is formed by means of two guide rods 11*a*, 11*b* arranged laterally next to the carrier part 16, on which guide rods the carrier part 16 is held and guided with running bushes 11*c*, 11*d* attached to the carrier part at the sides. In the exemplary embodiment, the guide rod 11*b* arranged near the second adjustment motor M2 is formed as spindle S2, which stands in a screw connection with the running bush 11*d* formed as a spindle motor. The adjustment motors M1, M2 are arranged outwardly of the running bushes 11*c*, 11*d*. The second adjustment motor M2 is connected with the spindle S2 by means of a belt drive, in particular a toothed belt drive.

The pivot device 17 has an intermediate lever 23 which at its one end is connected, pivotably in the vertical longitudinal middle plane, with the carrier part 16 by means of a first joint 24, and is connected at its other end, pivotably in the vertical longitudinal middle plane, with a head support lever 27 by means of a second joint 25. The intermediate lever 23 extends from the first joint 24 in an associated pivot range in substance in the direction away from the backrest 4. The head support lever 27 is located on the side of the intermediate lever 23 towards the head of a patient located on the treatment chair 1, whereby the intermediate lever 23 and the head support lever 27 are pivotable in the pivot ranges which can be understood from the Figures, in which they extend parallel to one another or enclose between them a small acute angle which is open in the direction towards the backrest 4 (FIGS. 1 and 3) or enclose a larger acute angle open towards the backrest 4 (FIG. 4). The second joint 25 is preferably arranged at the rearward end of the head support lever 27 so that this lever in this case extends from the second joint 25 in the direction towards the backrest 4 and thus the ends of the levers 23, 27 away from the backrest 4 terminate approximately with one another. The backrest pad 21 is located on the side of the head support lever 27 away from the intermediate lever 23.

The intermediate lever 23 and the head support lever 27 are each a so-called wide lever, i.e. it consists of two lever webs 23*a*, 27*a* having a horizontal spacing from one another and arranged on edge, of which the intermediate lever 23 or both levers are stabilized to a rigid lever component by means of a transverse part 23*b* preferably arranged at the upper edge, whereby the ends of the lever web 23*a* may extend freely standing away from the transverse part 23*b*. The lever web 27*a* of the head support lever 27 may be stabilized by means of a plate-like base part of the base part carrying the head support pad 21, which is preferably releasably attached to the head support lever 27, in particular can be clipped on or clipped off by means of exercise of manual pushing and pulling force. For this purpose there may serve one or more press-stud connections, which for reasons of simplification are not shown.

The intermediate lever 23 is selectively pivotable back and forth in the first joint 24 by means of a third adjustment motor M3 effective between this lever and the carrier part 16. The head support lever 27 is selectively pivotable back and forth in the second joint 25 by means of a fourth adjustment motor M4 effective between the head support lever and the intermediate lever 23. The adjustment motors M3, M4 have preferably an elongate or rod-like structure which is linearly effective in their longitudinal direction and form push and pull rods the longitudinal direction of which is substantially directed in the longitudinal direction of the associated lever 23, 27. The adjustment motor 113 associated with the intermediate lever 23 is pivotally supported, in the pivot plane, on the carrier part 16 transversely offset by an offset amount V1 with reference to the joint axis 24*a* of the joint 24, whereby its other end engages likewise pivotably on the intermediate lever 23 at a greater working distance from the joint 24, preferably engaging in the second joint 24. The offset amount V1 is preferably directed to the side away from the head support guide 27. The adjustment motor M4 associated with the head support guide 27 is jointedly supported on the intermediate lever 23 transversely offset by an offset amount V2 with regard to the joint axis 25*a* of the second joint 25, whereby its other end is jointedly connected with the head support lever 27 at a greater working distance from the joint 25, preferably connected in its end region towards the backrest 4. The head support lever 27 is preferably an angled lever having a transversely running lever arm 27*c* which in its end region associated with the second joint 25 stands away in an angled or curved manner and is connected at its free end in the second joint 25 with the intermediate lever 23. The intermediate lever 27 has in its end region towards the second joint 25 a transversely upstanding lever arm 23*c* which extends to the side towards the head support pad 21 and is jointedly connected with the associated end of the adjustment motor M4. The connection points for the adjustment motors M3, M4 are preferably formed by means of joints 31, 32, 33 with joint bolts which each pass through a joint part of the parts to be connected with one another in joint eyes. In the case of the exemplary embodiment having the above-described wide levers there are present in each case lever arms 23*c*, 27*c* having a transverse spacing from one another, which may be formed by extensions of the lever webs 23*a*, 27*a*. The adjustment motors M3, M4 are preferably arranged between the lever webs 23*a*, 27*a*, whereby there can be attained a slim or low profile construction. The length of the adjustment motors M3, M4 may correspond in substance to the length of the levers 23, 27.

The adjustment motors V3, V4 may be formed by means of hydraulic or pneumatic piston-cylinder units, or my have electric motors E3, E4, with each of which there is associated a transmission G3, G4 transforming their rotary movement into a longitudinal directed movement, preferably a spindle drive the spindle S3, S4 of which may form a part of the two telescopic adjustment motor parts.

For switching on and switching off the adjustment motors M1 to M4 there is associated therewith in each case a non-illustrated switch element, e.g. on a control apparatus or foot switch, with which the operating person can selectively switch on and off the adjustment motors M3, M4. For example for an adjustment individually controllable by the operating person or for a position in accordance with a predetermined program.

The head support 7 has a shell or trough-shaped head support surface 34, transverse to the pivot plane, which at least on a longitudinal section towards the backrest 4 extends substantially straight. In the region away from the backrest 4, the head support surface 34 can run out, whereby there may be formed a transverse swelling 35 of the pad 21 arranged in the associated end region.

Figure 3:
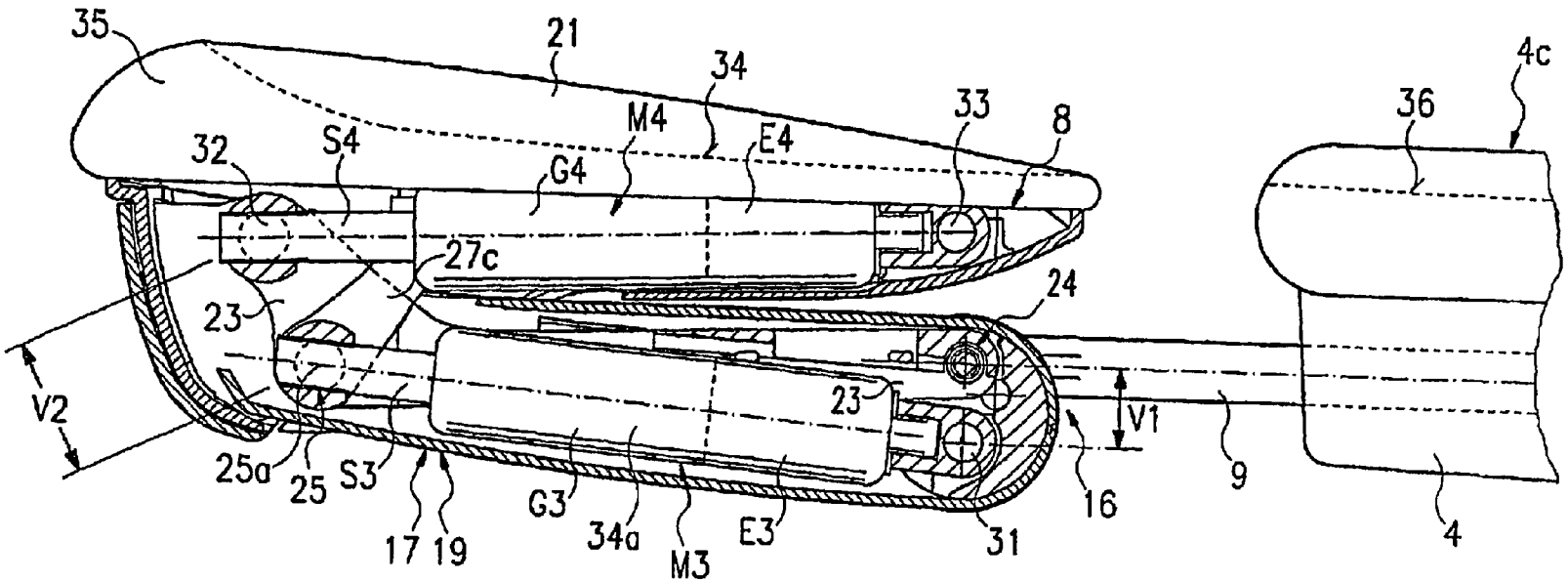
FIG. 3 the head support of the treatment chair, in an enlarged illustration in a side view.
Figure 4:
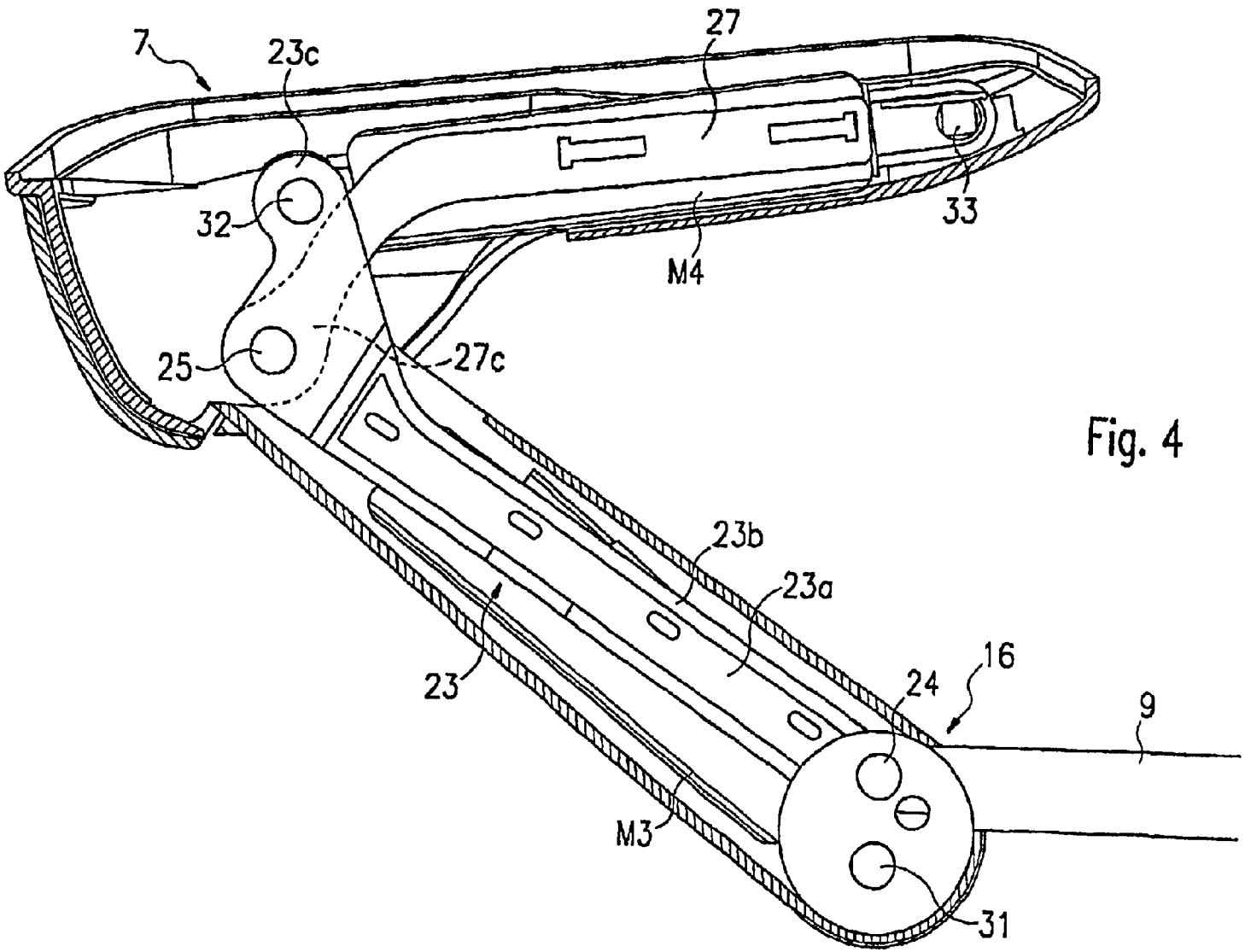
FIG. 4 the head support in a somewhat enlarged illustration and in its pivoted out support disposition.

The head support 7 can be adjusted into a child position illustrated in FIG. 3, in which the head support pad 21 is pushed directly or nearly onto the backrest pad 4*c*. In this position the head support surface 34 in substance aligns with the shell base or with the back support surface 36 of the backrest 4. Thereby, the head support surface 34 forms a largely transition-free continuation of the shell base of the backrest 4, which preferably is likewise formed to be trough-shaped, in the manner of the shell, transversely of the pivot plane. In this child position the shell base of the backrest 4 and the shell base of the head support 7 align with one another, through which the head of the child on the treatment chair is advantageously supported. On the one hand due to the head support surface 34 extending straight at least over a longitudinal section, and on the other hand due to the setting of the spacing of the back surface part 4*b* from the backrest joint 5, there can be attained an advantageous supporting of the head even with children of different sizes.

Figure 5:
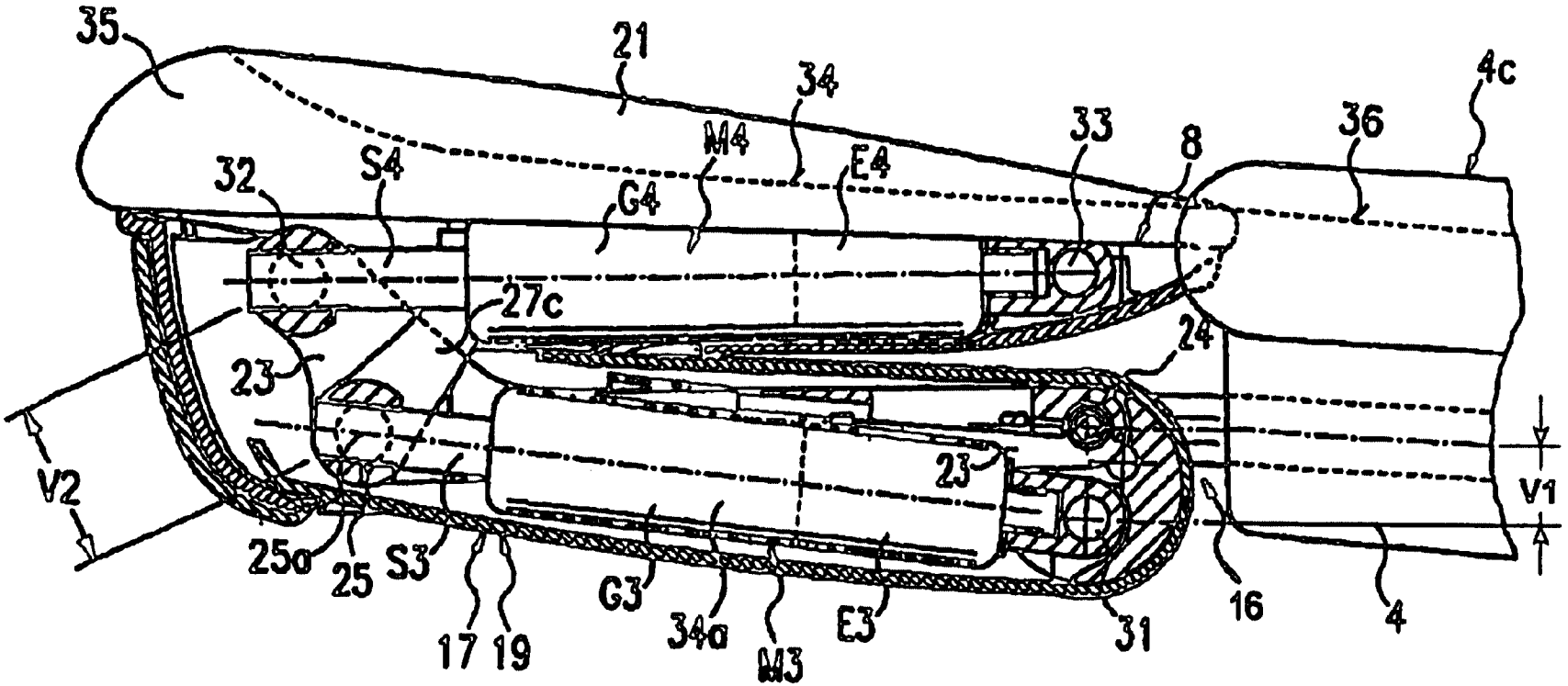
FIG. 5 the head support of FIG. 3 in a fully pushed down disposition.

The backrest 4 has at its free end preferably a recess 37, into which the head support 7 can be moved, in particular for the child position. FIG 5 illustrates the head support 7 in the fully pushed down disposition of the child position with the head support borne directly against the backrest pad 4*c*.

By means of the four adjustment motors V1 to V4 any desired position, required by the dentist, for all necessary kinds of treatment, can be attained. Thus it is possible for different kinds of treatment and different persons to attain the ideal setting of the treatment chair 1. The child position according to FIG. 3 and an elevated rounded back position can thus be set by means of motors.

By means of a program control, the adjustment motors are so programmed that the head support movements and the movement of the backrest 4 are adapted to the anatomical movements of the patient, That is, at times two, three or four adjustment motors work simultaneously and carry out different movement steps.

All four movements, two pivot movements and two longitudinal movements, are connected with a control unit via travel detectors. By these means it is possible to electronically detect patient data for the disposition on the patient chair, to store the data and then call it up again, upon the next visit by the patient.

If by means of the program control the desired ergonomically ideal head positioning is not attained, each of the four adjustment motors can be individually activated by means of a switch and thus the ideal head/back positioning attained.

What is claimed is:

1. Medical or dental treatment chair (1) comprising:

a) a seat part (2), b) a back part (4), c) a carrier part (16) arranged on the back part (4), d) an intermediate lever (23) which has one end pivotably connected in a first joint (24) with the carrier part (16), e) a head support lever (27) which has one end pivotably connected in a second joint (25) to an opposite end of the intermediate lever (23), f) a head support pad (21) carried by the head support lever, g) an intermediate lever adjustment motor (M3) which is effective between the carrier part (16) and the intermediate lever (23), and h) a head support lever adjustment motor (M4) which is effective between the intermediate lever (23) and the head support lever (27)

i) wherein the adjustment motors (M3, M4) are linearly acting adjustment motors, j) whereby the intermediate lever adjustment motor (M3) is pivotably supported at one end at a working spacing (V1) from the first joint (24) between the carrier part (16) and the intermediate lever (23), k) wherein the intermediate lever adjustment motor (M3) pivotably engages the intermediate lever (23), l) whereby the head support lever adjustment motor (M4) is pivotably supported at one end on the intermediate lever (23) at a working distance (V2) from the second joint (25), m) wherein the head support adjustment motor (M4) pivotably engages an opposite end of the head support lever (27), n) wherein the head support lever adjustment motor (M4) engages on a transverse arm (23*c*) of the intermediate lever (23), and o) whereby the transverse arm (23*c*) is angled relative to the intermediate lever (23) towards the head support lever (27), in an end region of the intermediate lever (23) adjacent the second joint (25).

2. Medical or dental treatment chair according to claim 1, wherein the opposite end of the intermediate lever adjustment motor (M3) engages in the second joint (25).

3. Medical or dental treatment chair according to claim 1, wherein the head support lever (27) is formed with an angled transverse arm (27*c*) that is angled relative to the head support lever (27) towards the intermediate lever (23) in an end region adjacent the second joint (25).

4. Medical or dental treatment chair according to claim 1, wherein connection points between the adjustment motors (M3, M4) and the levers (23, 27) are joints (25, 31, 32, 33) preferably having joint bolts which pass through associated joint eyes.

5. Medical or dental treatment chair according to claim 1, wherein the intermediate and head support levers (23, 27) each have at least two lever webs (23*a*, 27*a*), respectively, at a transverse spacing from one another, and which are each respectively connected with one another by a corresponding transverse part (23*b*, 27*b*).

* * * * *